US005606744A

United States Patent [19]

Lindy

[11] Patent Number: 5,606,744

[45] Date of Patent: Mar. 4, 1997

[54] BABY HEAD GUARD

[76] Inventor: Elaine Lindy, 36 Dexter Rd., Newton, Mass. 02160

[21] Appl. No.: 508,060

[22] Filed: Jul. 27, 1995

Related U.S. Application Data

[63] Continuation-in-part of Ser. No. 198,965, Feb. 18, 1994, abandoned.

[51] Int. Cl.[6] ..... A41D 11/00; A41D 13/00

[52] U.S. Cl. ..... 2/467; 2/410; 2/92; 2/468; 2/461; 5/655; 128/857

[58] Field of Search ..... 2/2, 410, 411, 2/412, 414, 415, 44, 45, 80, 205, 92; 5/636, 637, 655, 420; 224/209, 215, 160, 159, 259; 128/846, 845, 857, 869, 870, 873, 874, 875

[56] References Cited

U.S. PATENT DOCUMENTS

| | | | |
|---|---|---|---|
| 1,072,321 | 9/1913 | Fitch . | |
| 2,404,505 | 7/1946 | Knecht | 5/655 |
| 2,423,853 | 7/1947 | Ryan | 224/209 |
| 3,921,944 | 11/1975 | Morrison | 2/2 |
| 4,324,012 | 4/1982 | Cannaday | 2/2 |
| 4,434,513 | 3/1984 | Welch | 2/410 |
| 4,581,773 | 4/1986 | Cunnane | 2/204 |
| 4,689,844 | 9/1987 | Alivizatos | 5/655 |
| 4,726,085 | 2/1988 | Antonio | 5/655 |
| 4,745,637 | 5/1988 | Steele | 2/411 |
| 4,802,244 | 2/1989 | McGrath-Saleh | 2/80 |
| 5,075,903 | 12/1991 | Richoux | 2/411 |
| 5,165,130 | 11/1992 | Wendling | 5/655 |
| 5,220,700 | 6/1993 | Liu | 2/205 |

FOREIGN PATENT DOCUMENTS

| | | | |
|---|---|---|---|
| 4112320 | 10/1991 | Germany | 2/2 |

*Primary Examiner*—Michael A. Neas

[57] ABSTRACT

A substantially flat, wearable cushion (10) that a baby carries behind the head. The cushion (10) comprises a substance having impact absorbency (18) that is covered by a wrapper (20). Its corners are rounded and its size is wide enough to surround the baby's head and shoulders and long enough to hold two shoulder straps (12). Shoulder straps (12) are stretchable to ease the baby's arms into the device. Cushion (10) is supported behind the baby's head without any elements that visually or physically protrude around or upon the baby's head. If the baby slips, its head, as well as its neck and shoulders, will fall against cushion (10).

8 Claims, 2 Drawing Sheets

BABY HEAD GUARD

This is a continuation-in-part of Ser. No. 08/198,965, filed Feb. 18, 1994, now abandoned.

BACKGROUND—FIELD OF INVENTION

This invention relates to baby protective headgear.

BACKGROUND—DESCRIPTION OF PRIOR ART

From the time babies first stand, they are often unsteady on their feet. Such unsteadiness usually lasts from the last quarter of the first year (or for ambitious babies, as early as seven months), to when their balance is established at approximately 18 months old. When wobbly babies fall, they tend to fall backward more often than forward. In falling backward their heads will land with a thud against furniture, corners, railings, or other protrusions and hard surfaces. Babies who haven't yet mastered the art of bending their knees are especially at risk for high-impact falls. Climbers also face greater risk because they will fall from an elevated height.

Even in homes baby-proofed with cushioned devices around sharp corners and edges, babies seem unerringly to discover those surfaces that are unprotected. Hard kitchen floors, chairs, and wall corners all present genuine hazards to a spinning and pitching baby. Indeed, no amount of baby-proofing can address these and other potentially hazardous surfaces.

An additional threat to the baby's head occurs when the baby is facing down and suddenly raises or flips the head up. For example, babies crawling under tables or chairs may suddenly raise the head and hit furniture parts or edges.

Prior art offers several head guards for the mobile baby. However, the designs heretofore contain two serious defects.

First, the method of securing the head guard to the baby involves wrapping an extendible member around the baby's head and/or under the baby's chin. Babies widely object to any item that confines the head, as most parents will confirm who struggle to apply hats, bibs, and to pull clothing on and off over the head. Whether babies find binding items itchy, hot, or just plain don't like anything rubbing against their skin we'll never know for certain. Typically, babies will tug at constricting apparel, especially easily reachable items around the head or neck, and fuss until the offender is removed. Chin straps are especially dreaded by babies and parents alike because in order to be secured enough to hold they must be tightened against the skin under the neck. Moreover, chin straps get wet from dribbles, and wet straps will chafe baby skin even more quickly.

U.S. Pat. No. 5,075,903 to Richoux (1991) proposes a baby head guard that consists of a rounded padded disc secured to the back of the baby's head with a headband and held in place with a chin strap. It is unlikely a baby would be content very long with this device bound around its head and chin. Similar in this respect are U.S. Pat. No. 1,072,321 to Fitch (1913), U.S. Pat. No. 4,581,773 to Cunnane (1986), and U.S. Pat. No. 4,745,637 to Steele (1988).

The second defect of prior art is that the protection provided by the head guard is limited to the head itself. When a baby falls, not only its head but also its neck, shoulders, and upper back may be injured, particularly if the baby lands against a surface with multiple sharp edges. The Richoux patent protects the occiput of the head, that is, the lower rear and mid skull area. The Fitch and Steele designs protect the top and sides of the head. The Cunnane design protects the whole of the head (though it covers the baby's ears and therefore arguably may interfere with audio-sensory development). None of these designs extend protection from the baby's head to the neck, shoulders and upper back areas.

U.S. Pat. No. 4,434,513 to Welch (1984) comprises a panel edged by a roll that curves to surround a baby's head and extends downward along each side of a baby's back. This head guard has no attachable elements whatsoever and therefore can be used only for resting against and is not functional for the mobile baby. Moreover, the panel itself is not thickly padded and thus cannot provide impact protection to the baby.

OBJECTS AND ADVANTAGES

According, several objects and advantages of the present invention are:

(a) To provide a baby head guard that reliably cushions the impact of backward falls.

(b) To provide a baby head guard that is safe and comfortable for the baby.

(c) To provide a baby head guard that is harnessed upon the baby without attachments that wrap around the baby's head or chin.

(d) To provide a baby head guard that minimizes contact between the cushion and the baby's head.

(e) To provide a baby head guard that extends protection to the baby's neck, shoulders and upper back.

(f) To provide a baby head guard that softens the impact of contact with hard surfaces when the baby is facing down and suddenly raises or flips the head upward.

(g) To provide a baby head guard that does not interfere with a baby's mobility.

(h) To provide a baby head guard that is easy to use.

Further objects and advantages are to provide a baby head guard that is lightweight, appealing aesthetically, and simple and economical to manufacture.

Still further objects and advantages will become apparent from a consideration of the ensuing description and drawings.

SUMMARY

The present invention accomplishes the above-stated objects and advantages by providing a wearable cushion that attaches onto the torso of the baby with shoulder straps.

The cushion is a rounded, flat, thick, lightweight substance wrapped in a material such as fabric. It extends beyond the baby's head and downward to behind the baby's shoulders and upper back. Onto the cushion, two C-shaped stretchable shoulder straps-are attached. The shoulder straps are stretchable to ease the baby's arms into the device.

The baby's arms are slipped into the shoulder straps and the flat cushioned surface is supported behind the baby's head and upper torso. Thus, the baby carries the cushioned surface around. The back of the baby's head may not touch the cushion at all, or may merely brush the cushion. Should the baby slip and fall, the cushion is automatically in the right place to soften the impact from hard or sharp surfaces against the baby's head as well as the baby'neck, shoulders and mid-back area.

DRAWING FIGURES

REFERENCE NUMERALS IN DRAWINGS

Figure 1:
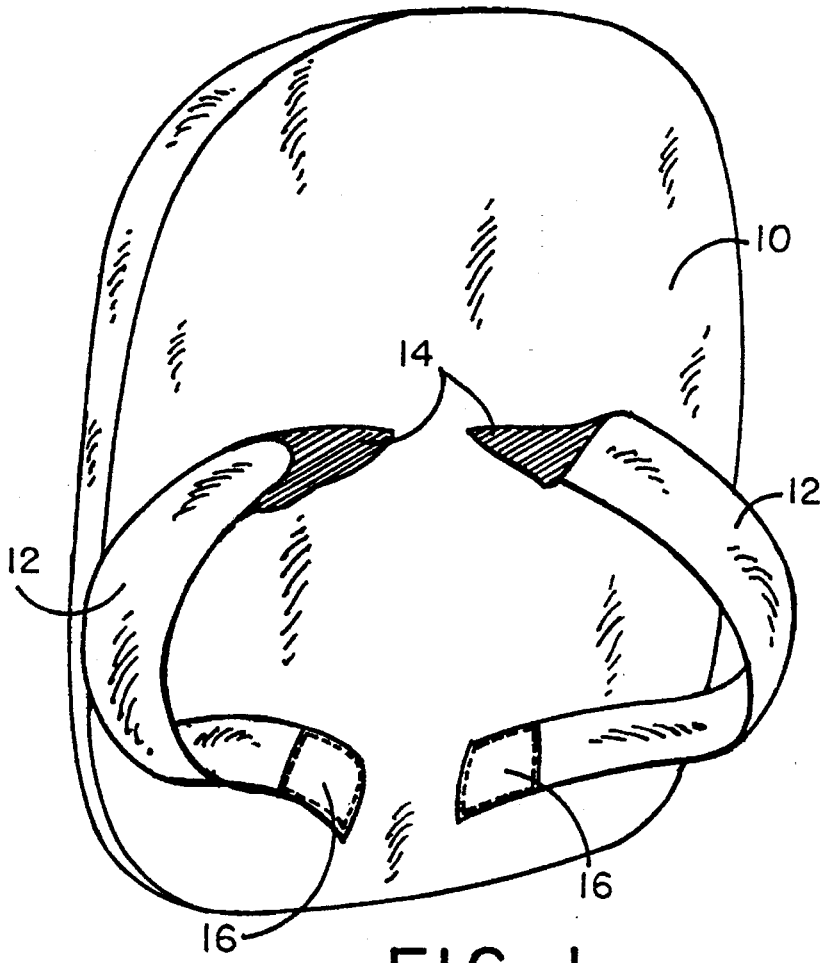
FIG. 1 is a front view of a baby head guard in accordance with my invention.

| | |
|---|---|
| 10 | Cushion |
| 12 | Shoulder straps |
| 14 | Elasticized section |
| 16 | Reinforcing |
| 18 | Pad |
| 20 | Wrapper |

DESCRIPTION—FIGS. 1 to 5

The baby head guard is comprised of a cushion 10 (FIG. 1) that is wide enough to surround the baby's head and shoulders and long enough to anchor two shoulder straps 12. The straps 12 provide harnessing means for securing cushion 10 onto the body of the baby without employing any attachments that wrap around the baby's head.

In the present embodiment cushion 10 is constructed of a pad 18 (FIG. 3) covered by a wrapper 20. Pad 18 is either a thick dense foam, a lighter foam backed by a hard yet flexible plastic, or a similar soft, comfortable and preferably water-resistant substance that will absorb impact. Wrapper 20 consists of any lightweight, rugged material such as fabric, which improves the durability and washability of pad 18. In addition, wrapper 20 can be printed with an appealing design.

Cushion 10 extends in all directions beyond the baby's head, but not so far that it becomes unwieldy, and also extends downward in the vicinity of the baby's mid-back. This shape expands the protective feature because the baby's upper shoulders and upper back typically land when the head lands. The edges of cushion 10 are rounded to ease maneuverability for the baby wearing the device. The optimum size and shape for the cushion is about 350 centimeters long by 290 centimeters wide by 25 centimeters thick. Cushion 10 should be larger than the size of a baby's head when seen looking at the baby's face from the front.

Shoulder straps 12 are each about 300 centimeters long and 50 centimeters wide and have two ends, both of which are attached to cushion 10 within the lower half horizontally of cushion 10. The upper end of each strap is attached to the midpoint area of the cushion, and the lower end of each strap is attached to the lowermost area of the cushion. The shoulder straps are padded for the baby's comfort. An elasticized section 14 at the upper end of each strap 12 provides stretchability so the baby's arms can be easily slipped into and out of the device. The lower end of each strap 12 is reinforcably attached to cushion 10. Reinforcing 16 anchors strap 12 when it is pulled from several directions. In the present emobiment reinforcing 16 is approximately square with 50 centimeters on each side. To help ensure that straps 12 fit the baby's body snugly and do not slip off the shoulders, the upper edges of the straps 12 are angled, and the tips of the angles point upward toward the center of cushion 10.

Figure 2:
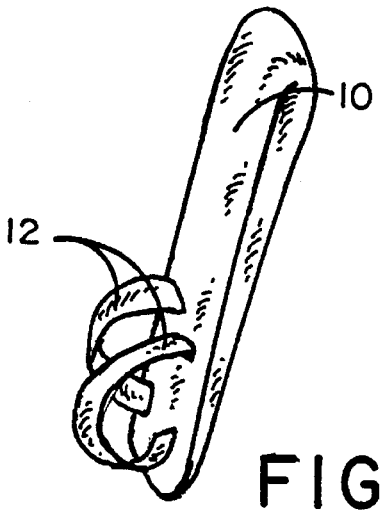
FIG. 2 is a side view of the baby head guard, showing how its width tapers downward.
Figure 3:
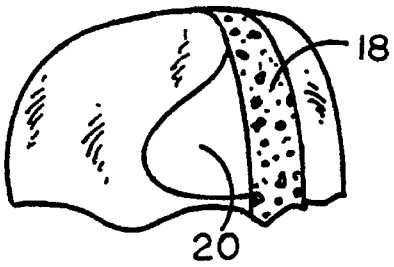
FIG. 3 is a view of a cushion of the baby head guard.

FIG. 2 is a side view of the baby head guard. As shown, cushion 10 tapers from top to bottom from about 25 centimeters at the top to about 15 centimeters at the bottom. If the baby lies on the floor facing up, the edge of cushion 10 that contacts the floor is the edge that is flat and the edge that contacts the baby is the edge that tapers. Alternatively, a tapering from the edge that contacts the floor toward the edge that contacts the baby, or a tapering of both edges equally would also provide a gentler slope than if both edges of cushion 10 remained parallel. However, the latter design, that is with two untapered, parallel edges, remains functional and is the most cost-effective to manufacture.

Figure 4:
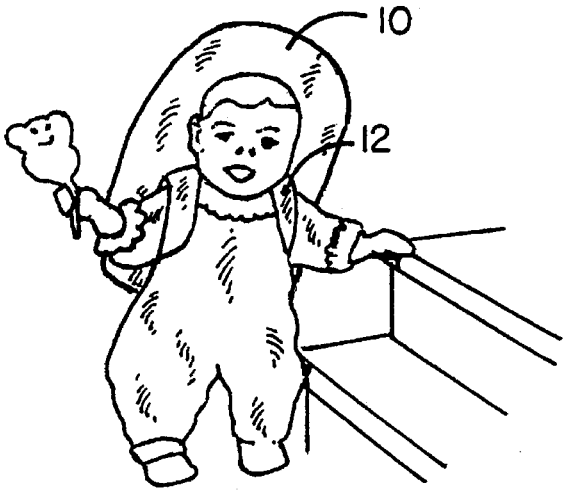
FIG. 4 is a front view of a baby wearing the baby head guard.
Figure 5:
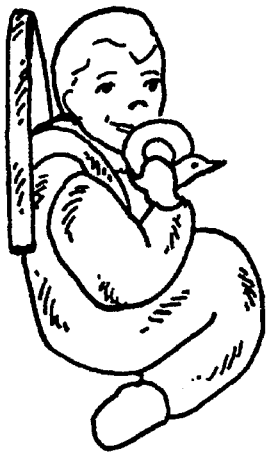
FIG. 5 is a side view of a baby wearing the baby head guard.

FIG. 4 and FIG. 5 are front and side views, respectively, of a baby wearing the baby head guard.

OPERATION

To secure the baby head guard to the baby, one simply eases the baby's arms into shoulder straps 12. The straps 12 slip over whatever clothing the baby may be wearing. Though the baby head guard may be frequently used inside the home, straps 12 can also be applied over coats and jackets for safer outdoor play. The baby will be virtually unaware of the presence of straps 12. The baby's head will merely brush against the surface of cushion 10, and may not even touch it at all (FIG. 5). As long as cushion 10 is secured behind the baby, it will be available to soften a backward fall no matter where the baby is or against what surface the baby falls.

Of further benefit is that cushion 10 will help protect the head when the baby is facing downward and suddenly raises or flips the head up. Moreover, cushion 10 serves as an instant pillow for babies who enjoy lying down on kitchen floors, playpens, and other hard surfaces. Further, cushion 10 serves as a changing mat when it comes time to change a diaper. What's more, nursing mothers will enjoy the instant privacy the length and breadth of cushion 10 provides.

To remove the baby head guard from the baby, one simply slips both arms out of straps 12.

CONCLUSIONS, RAMIFICATIONS, AND SCOPE

Accordingly, it can be seen that my baby head guard accomplishes the stated goal of continuously cushioning the impact of backward falls without the use of wrappings that confine the mobile baby's head or chin, and it also extends protection from the baby's head to the baby's neck, shoulders and upper back areas. In addition to coverage of backward falls, my baby head guard cushion impacts from sudden upward surges.

The baby head guard is safe and comfortable for the baby. It does not interfere with the baby's mobility. It is convenient for the parent or caregiver.

The baby head guard may be embodied in variations and/or other specific forms other than that illustrated without departing from the spirit or essential characteristics thereof. For example, the cushion may consist of one uniform substance, rather than a pad covered by a wrapper. The cushion can be flared or extended at the sides to offer side support. The wrapper can be detachable for convenient washing. The shoulder straps can contain adjusting means for shortening and loosening their length. Rather than shoulder straps, other harnessing means such as waist or chest straps can be employed around the baby's body. Also a connecting strap can be provided in front of the baby between the two shoulder straps to hold pacifiers, toys or other diversions. The cushion can be sized to serve an older child, the elderly or the infirm.

Although the above description contains many specificities, these should not be construed as limiting the scope of the invention but as merely providing illustrations of some of the presently preferred embodiments of this invention. Other embodiments and ramifications are possible. For example, the cushion can be thicker or thinner, rounded or squared, or shaped with any variety of elements to promote a particular design. The cushion can extend to cover behind the baby's back entirely. It can taper downward at different angles, or not taper at all. The padding can consist of a variety of substances. The shoulder straps could be thicker or thinner. They can include an elasticized section, be made entirely of stretchable material, or have no stretchability at all. They can contain adjusting means. The illustrated embodiment is therefore to be considered in all respects as illustrative and not restrictive.

Thus the scope of the present invention should be determined by the appended claims and their legal equivalents, rather than by the specifics in the description, and all changes which come within the meaning and range of equivalency of the claims are intended to be embraced thereby.

What I claim is:

1. A baby head guard adapted to be worn by a mobile baby of predetermined size that softens the impact of backward falls against said baby's head, neck, shoulders, and upper back areas, comprising:

(a) a cushion having a predetermined thickness, said cushion having two opposing ends, two opposing sides, and two flat opposing major faces, said cushion existing substantially within a single plane, said cushion having substantially no protruberances that extend toward said baby, said cushion having a predetermined length so that it extends from the mid-back area of said baby to above said baby's head when placed adjacent to said baby's back, and (b) a pair of straps attached to said cushion, each of said straps having an upper end and a lower end, said upper end of said strap being attached to one major face of said cushion at an approximate midpoint of said major face between said two opposing ends and between said two opposing sides, the position of said attachment being such that when said head guard is worn by said baby, said upper end of said strap extends substantially from behind said baby's neck, said lower end of each strap being attached to one major face of said cushion adjacent to one opposing end thereof, each of said straps being long enough to form a loop which can extend over one of said baby's shoulders and underneath said baby's arms.

2. The baby head guard of claim 1 wherein said straps are stretchable so as to enable said straps to be conveniently placed onto and removed from said baby.

3. The baby head guard of claim 1 wherein each of said opposing ends of said cushion has a substantially curved shape.

4. The baby head guard of claim 1 wherein said cushion is approximately 31 centimeters long and approximately 24 centimeters wide.

5. The baby head guard of claim 1 wherein said cushion is approximately 2.5 centimeters thick.

6. The baby head guard of claim 1 wherein said cushion is approximately 31 centimeters long, approximately 24 centimeters wide, and approximately 2.5 centimeters thick.

7. The baby head guard of claim 1 wherein said straps are each approximately 30 centimeters long and approximately 5 centimeters wide.

8. A method of protecting the head, neck, and back of a mobile baby of predetermined size from backward falls, comprising:

(a) providing a cushion having a predetermined length, width, and thickness with two opposing ends, two opposing sides, and two flat opposing major faces, said cushion existing substantially within a single plane, said cushion having substantially no protruberances that extend toward said baby, the length of said cushion being such that said cushion will extend from the mid-back area of said baby to above said baby's head when said cushion is placed adjacent to the back, neck, and head of said baby, said cushion having a pair of straps attached thereto, said pair of straps each having an upper end and a lower end, said upper end of said strap being attached to a midpoint area of one of said major faces of said cushion between said opposing ends and between said opposing sides, the position of said attachment being such that when said head guard is worn by said baby, said upper end of said strap extends substantially from behind said baby's neck, and said lower end of said strap being attached to said one of said major faces adjacent to one opposing end of said cushion, and (b) attaching said cushion to a mobile baby by extending said straps around said baby's respective shoulders so that said one major face of said cushion is adjacent to said baby's back, neck, and head and extends upward from a midpoint of said baby's back to above said baby's head, whereby when said baby crawls, stands, totters or otherwise moves around, no elements visually or physically protrude around or upon said baby's head, and when said baby falls backward, said cushion softens the impact of said backward falls upon said baby's back, neck, and head areas.

* * * * *